US005895164A

United States Patent [19]

Wu

[11] Patent Number: 5,895,164

[45] Date of Patent: Apr. 20, 1999

[54] PAPER BINDING DEVICE

[76] Inventor: Ming-Chuan Wu, 4F-3, No. 311, Sec. 4, Chung Hsiao E. Rd., Taipei, Taiwan

[21] Appl. No.: 09/061,940

[22] Filed: Apr. 17, 1998

[51] Int. Cl.[6] ..... B42F 3/04

[52] U.S. Cl. ..... 402/36; 402/31; 402/38

[58] Field of Search ..... 402/26, 31, 36, 402/37, 38, 39, 40, 41

[56] References Cited

U.S. PATENT DOCUMENTS

| | | | |
|---|---|---|---|
| 2,178,546 | 11/1939 | Trussell | 402/39 X |
| 3,135,266 | 6/1964 | Bouhier | 402/39 X |
| 5,788,391 | 8/1998 | Cheung | 402/31 X |

*Primary Examiner*—Willmon Fridie, Jr.

[57] ABSTRACT

A paper binding device includes a base, two binding ring assemblies, a pull plate, and a bottom plate. By causing the pull plate to displace forwardly and rearwardly in the center of the base, positioning pins on the pull plate may displace in corresponding guide slots of the binding ring assemblies to force the binding ring assemblies to open or close. The pull plate further has stop pieces that may firmly secure the binding ring elements in position when the binding ring assemblies are in a closed state. The pull plate effectively eliminates the problem of small open angle with conventional paper binding devices which make it difficult to bind papers.

6 Claims, 6 Drawing Sheets

PAPER BINDING DEVICE

BACKGROUND OF THE INVENTION

1. Field of the Invention

The present invention relates generally to a paper binding device, and more particularly to a paper binding device having a unitary device to control the opening or closing of the binding device for keeping papers.

2. Description of the Prior Art

Conventional binding devices for binders have various problems. The binding force of the binding device will decrease with time so that it cannot properly hold the papers in place. The binding rings may hurt or clamp the user's fingers if not properly manipulated. Besides, the binding rings are generally openable at an angle of about 30° and unable to open at a relatively large angle since the binding rings are generally operated by springs that are not allowed much change in angle in the limited space of the binding device. Because of this defect, the user cannot slip a big pile of paper directly onto the binding rings of the binder at one time and has to divide it into several small piles before she/he can put them in place, keeping alert that the binding rings may abruptly close to hurt her/his fingers.

SUMMARY OF THE INVENTION

The present invention relates generally to a paper binding device, and more particularly to a paper binding device having a unitary device to control the opening or closing of the binding device for keeping papers.

A primary object of the present invention is to provide a paper binding device with a strong holding capacity. Apart from being capable of automatically control the opening and closing of the binding rings, it also provides a securing device to positively secure the binding rings. For a large pile of paper or documents, the binding device of the present invention allows a relatively large open angle to allow fast placement of paper. By utilizing positioning pins that displace in guide slots and the change in angle and distance of the guide slots on the binding ring assemblies, the binding rings are openable to above 90° to allow much faster placement of paper. The open angle is also adjustable. A pull tab is provided at a tail end of a pull plate to allow the user to easily and safely control of the opening and closing of the binding rings.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
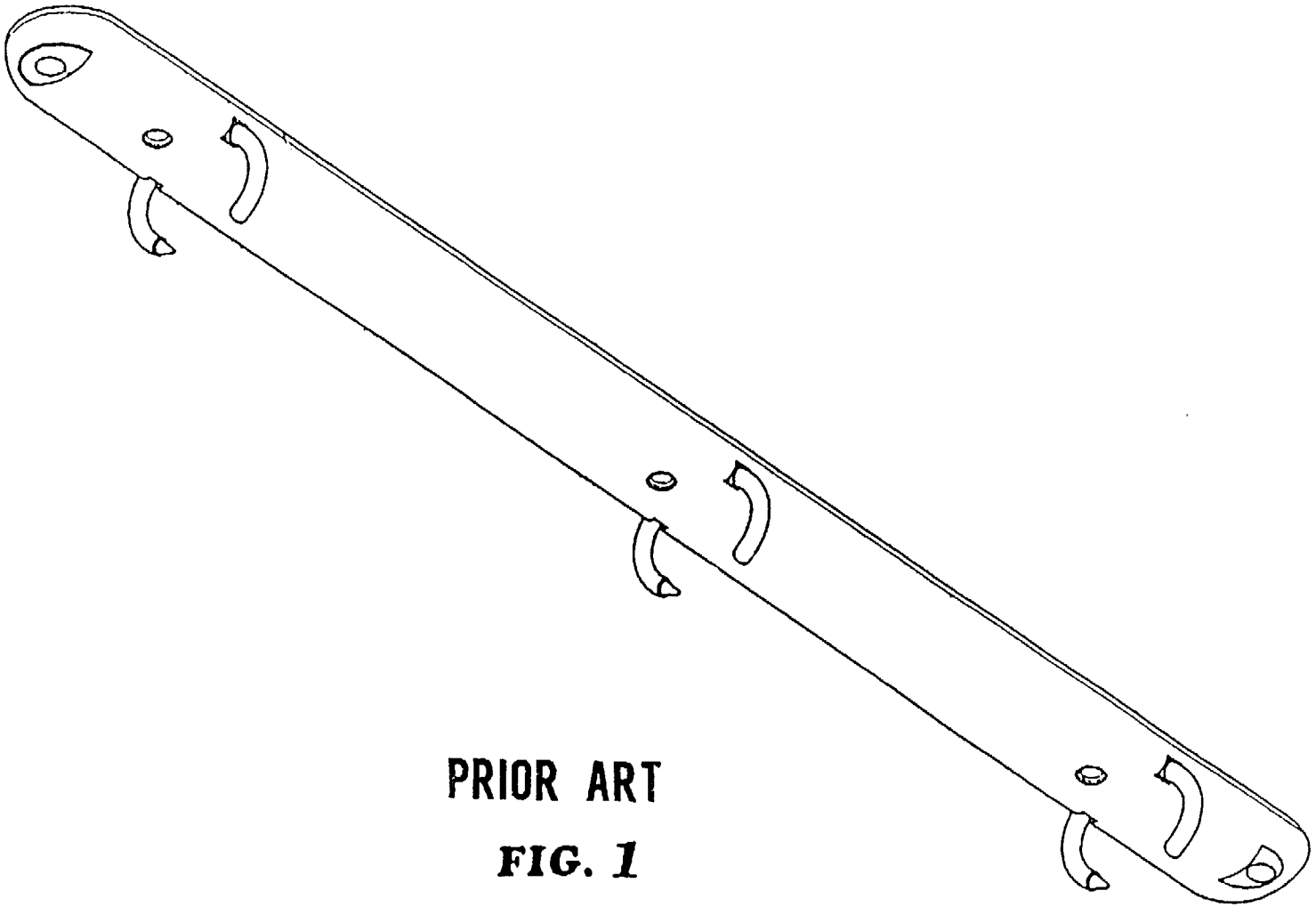
PRIOR ART FIG. 1
FIG. 1 illustrates a conventional binding device.
Figure 2:
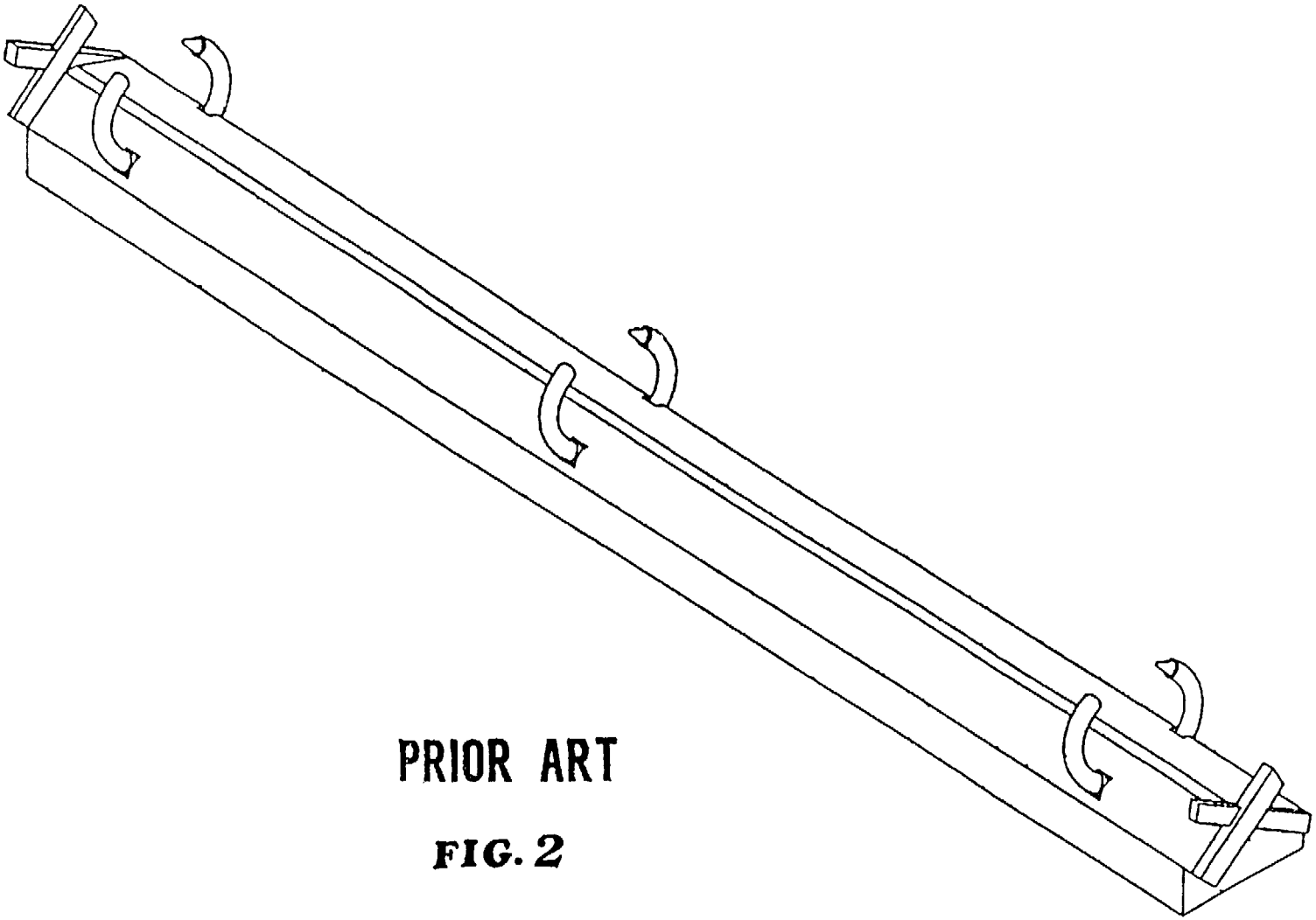
PRIOR ART FIG. 2
FIG. 2 illustrates another conventional binding device.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 3:
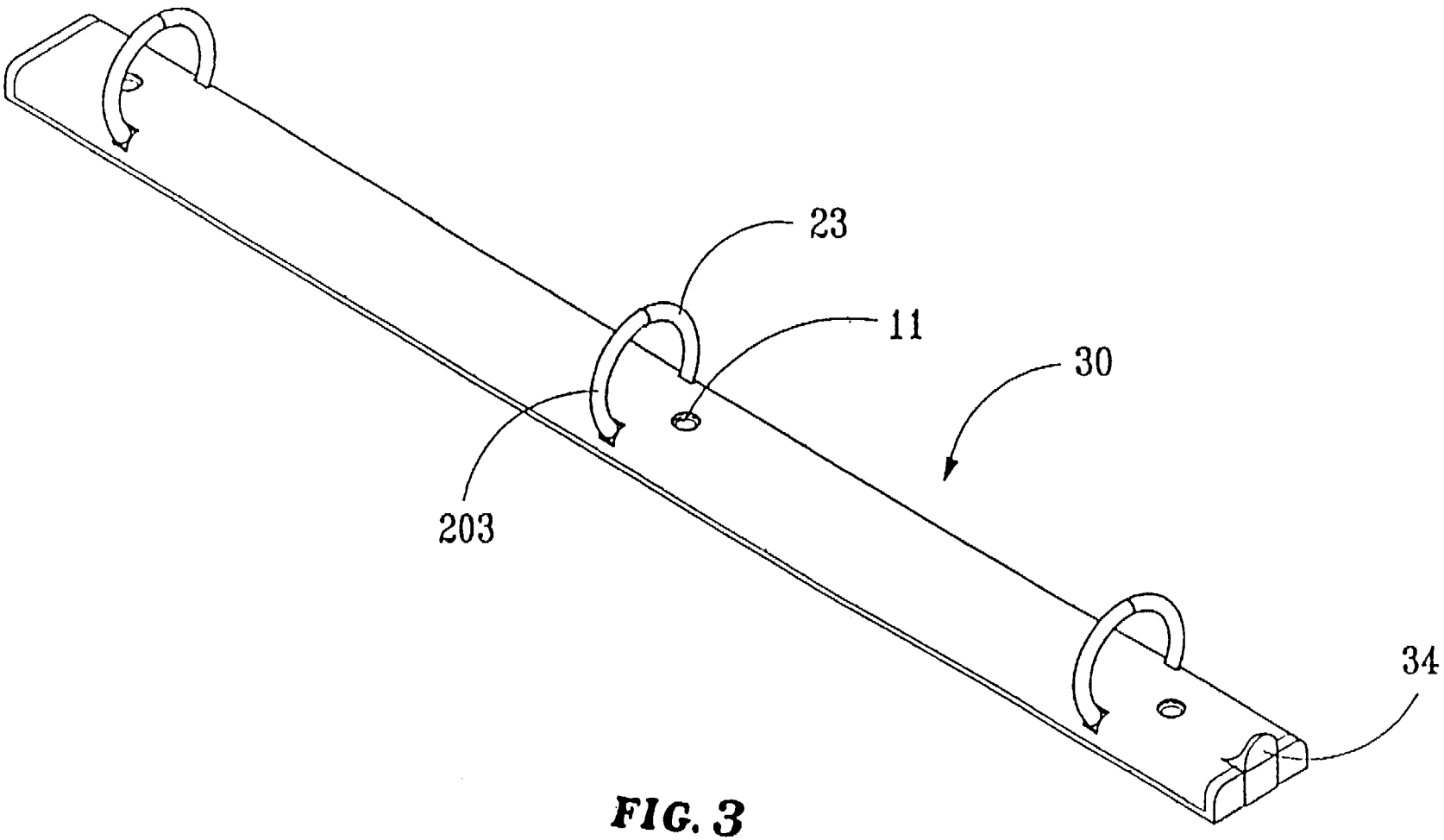
FIG. 3 is a perspective assembled view of the present invention.
Figure 4:
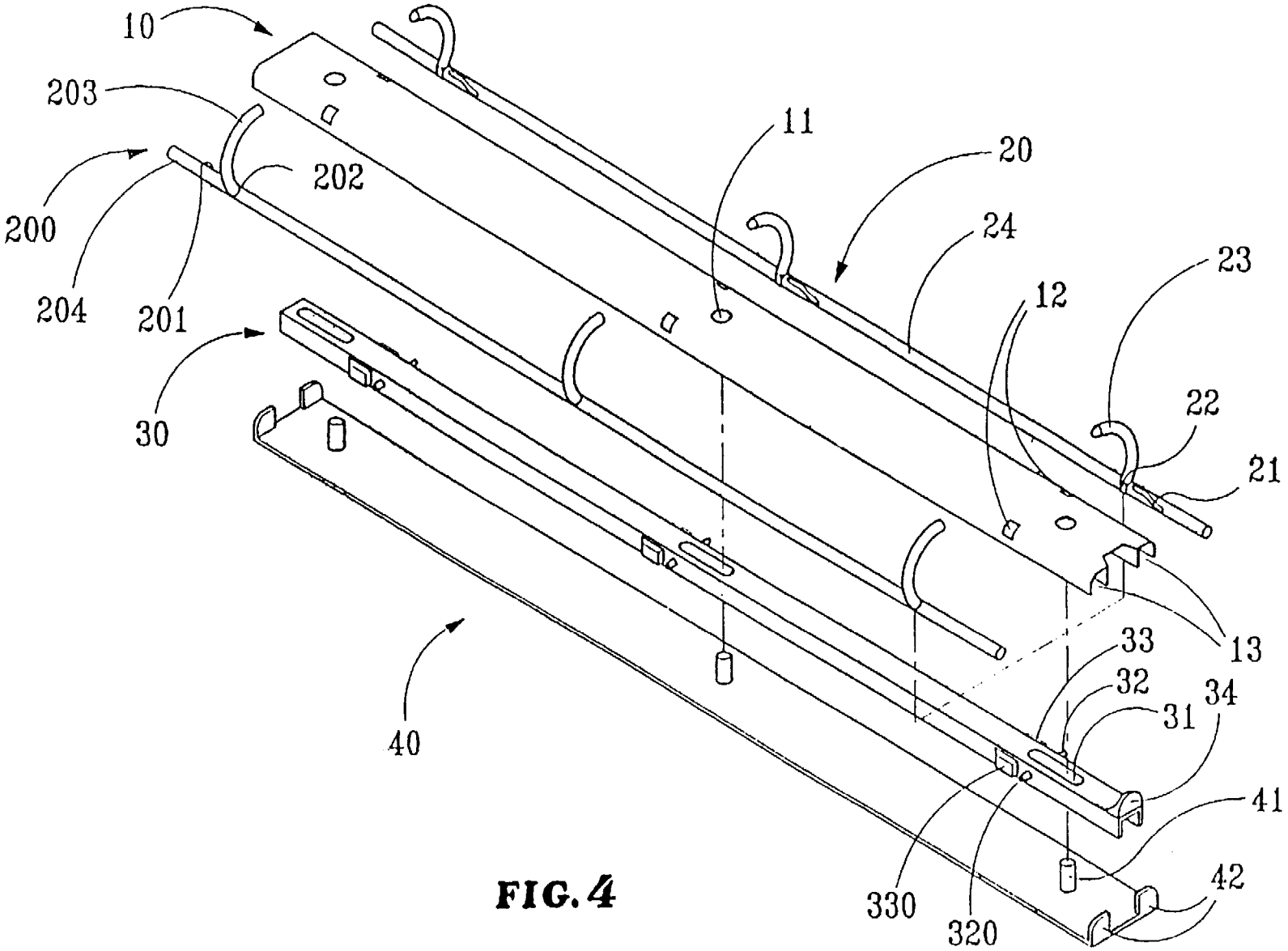
FIG. 4 is a perspective exploded view of the present invention.

Referring to FIGS. 3 and 4, the present invention comprises a base 10, binding ring assemblies 20, 200, a pull plate 30, and a bottom plate 40. The base 10 is formed with two narrow grooves 13 at both sides of its bottom side running axially therethrough. The grooves 13 respectively receive binding ring assemblies 20 and 200. Slots 12 are formed on both sides of the base 10 along the axis thereof above the grooves 13 and are spaced apart at a suitable distance. A plurality of securing holes 11 are spaced suitably apart along the axial centerline of the base 10 for receiving corresponding securing pins 41 of the bottom plate 40 (to be described in detail hereinafter).

The binding ring assemblies 20 and 200 are substantially symmetrical in structure. Each binding ring assembly 20 (200) further includes an elongate rod 24 (204). Spaced suitably apart along the axis of the rod 24 (204) at an inner side are units each including a guide slot 21 (201), a stop piece 22 (202) and a binding ring element 23 (203) such that each guide slot 21 (201) is disposed at an axial joint between the bottom end of the corresponding binding ring element 23 (203) and the corresponding stop piece 22 (202) and extends downwardly along the axis of the rod 24 (204). The radial vertical face and upper and lower faces of each stop piece 22 (202) respectively cut the circumference of the rod 24 (204). Each binding ring element 23 extends upwardly and terminates in an alignment pin 231, whereas each binding ring element 203 extends upwardly to terminate in an alignment hole 2031.

The pull plate 30 includes a plurality of elongate slots 31 spaced suitably apart along the axial centerline thereof, and positioning pins 32 and 320 and their corresponding securing buttons 33 and 330 provided on both sides at each end. The number of the positioning pins 32, 320 and stop buttons 33, 330 is the same as that of the binding ring elements 23, 203. A pull tab 34 is further provided at a tail end of the pull plate 30. The user may manipulate the pull tab 34 with his fingers so as to cause the pull plate 30 to displace forwardly or rearwardly within the base 10.

The bottom plate 40 includes a planar bottom side and an upper side provided with securing pins 41 corresponding to the elongate slots 31 of the pull plate 30, and a pair of stop pieces 30 at each axial end. The securing pins 41 may pass through the elongate slots 31 of the pull plate 30 so that the upper side of the bottom plate 40 is coupled to the bottom side of the pull plate 30, whereas the base 10 covers the upper side of the pull plate 30 with the binding ring assemblies 20, 200 respectively housed in the elongate grooves 13 thereof, such that the binding ring elements 23, 203 pass through the slots 12 of the base 10, thereby accomplishing the binding device as shown in FIGS. 3 and 4.

Figure 5:
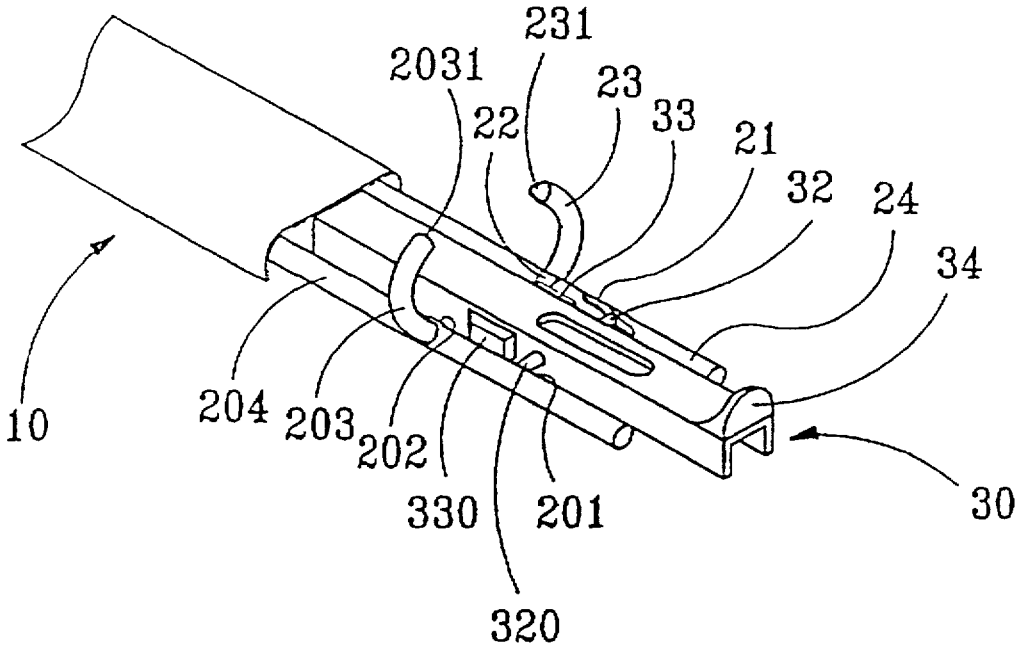
FIG. 5 is a perspective view of the present invention in which the binding rings are closed.

Referring to FIG. 5, when the pull plate 30 is pulled outwardly, the binding ring elements 23 and 203 are forced to open. The positioning pins 32, 320 are respectively located at the front ends of the corresponding guide slots 21, 201, and the securing buttons 33, 330 are likewise located at the respective front ends of the stop pieces 22, 202 contiguous to the inner sides of the guide slots 21, 201 respectively. At this point, the greatest displacement of the pull plate 30 is equivalent to that of the securing pins 41 of the bottom plate 40 in the corresponding elongate slots 31 of the pull plate 30.

Figure 6:
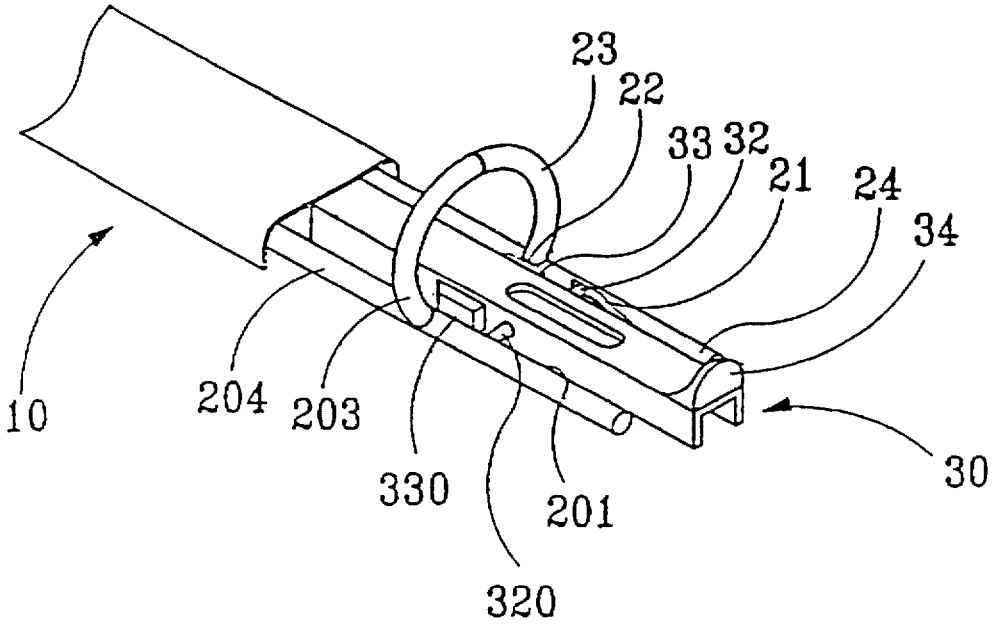
FIG. 6 is a perspective view of the present invention in which the binding rings are open.

Referring to FIG. 6, when the pull plate 30 is pulled along the axial direction to the end, the binding ring elements 23 and 203 are forced to close, with the alignment pins 231 and the alignment holes 2031 engaging each other, and the positioning pins 32, 320 of the pull plate 30 located at the rear end of the corresponding guide slots 21, 201, and the securing buttons 33, 330 located at the inner sides of the front ends of the respective stop pieces 22, 202 in a locked position. At this point, the greatest displacement of the pull plate 30 is equivalent to that of the securing pins 41 in the corresponding elongate slots 31.

Figure 7:
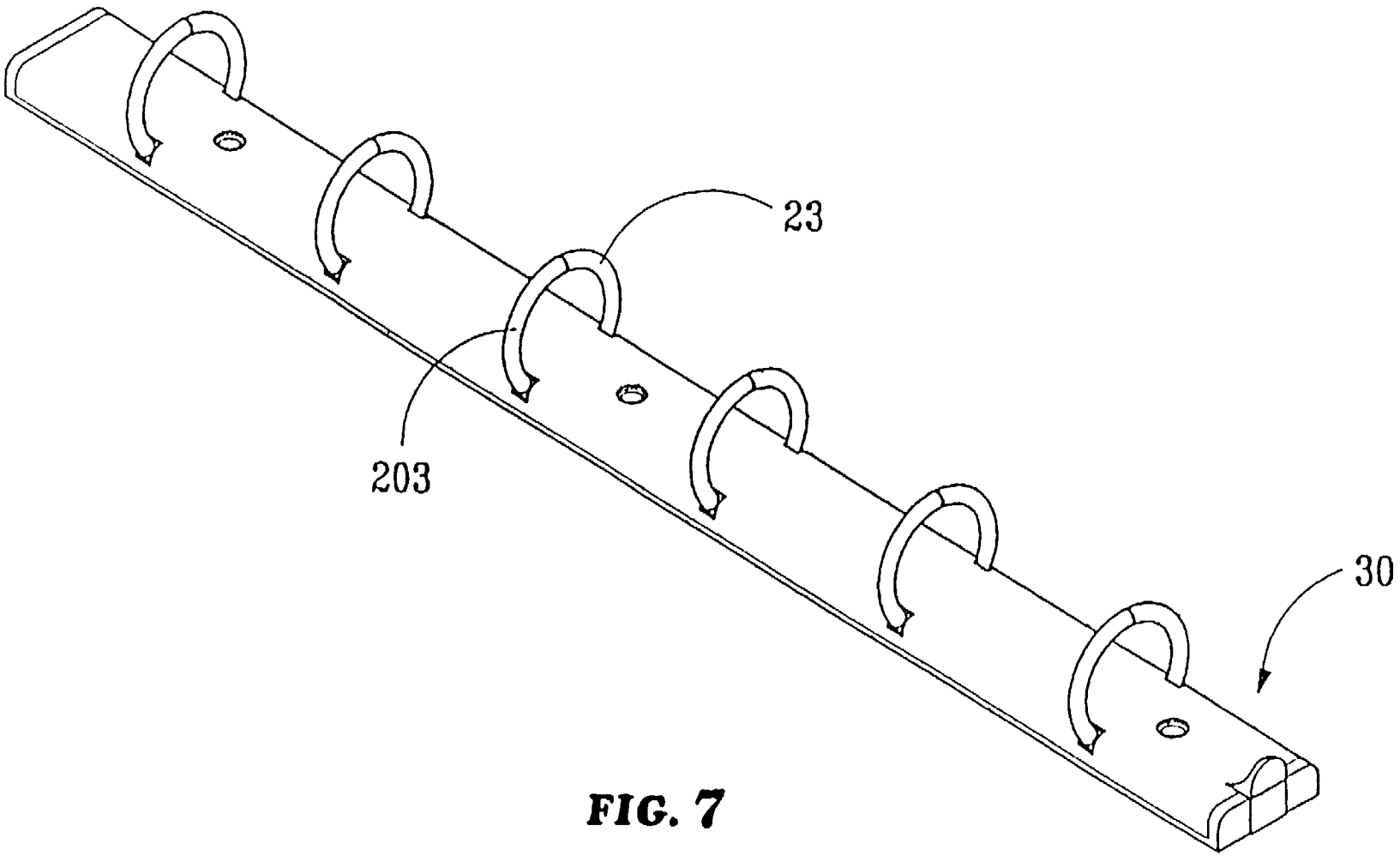
FIG. 7 is a perspective view of another embodiment of the present invention.

FIG. 7 illustrates another embodiment of the present invention. The number of binding ring elements 23, 203 may be increased as required. Although the present invention has been illustrated and described with reference to the preferred embodiment thereof, it should be understood that it is in no way limited to the details of such embodiment but is capable of numerous modifications within the scope of the appended claims.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A paper binding device, comprising:

a base, said base being formed with two elongate grooves on both sides of a bottom side thereof, said grooves running axially through the length of said base, said base being provided with pairs of opposite slots formed on both sides of said base along an axis thereof above said grooves and spaced suitably apart from each other;

a plurality of securing holes being spaced suitably apart along an axial centerline of said base for receiving corresponding securing pins of a bottom plate, binding ring assemblies, said binding ring assemblies being substantially symmetrical in structure and being housed in said grooves at the bottom side of said base, each of said binding ring assemblies including an elongate rod, said rod having units comprising a guide slot, a stop piece, and a binding ring element spaced suitably apart along an axis thereof at an inner side, wherein said guide slots are located on said rod to control a largest open angle of said binding ring elements;

said stop pieces are engageable with securing buttons of a pull plate to secure said binding ring assemblies in a closed state; and said binding ring elements of one of said binding ring assemblies extend upwardly to terminate in respective alignment pins, whereas those of the other of said binding ring assemblies extend upwardly to terminate in respective alignment holes, which receive said alignment pins when said binding ring assemblies are in a closed state;

said pull plate, extending along an axial centerline thereof and located in the center of said base between said grooves, said pull plate including a plurality of elongate slots spaced suitably apart along the axial centerline thereof to control largest forward and rearward displacement of said pull plate;

said pull plate further including positioning pins and said securing buttons on both sides thereof at each end, the number of said positioning pins and stop buttons being the same as that of said binding ring elements, a pull tab being further provided at a tail end of said pull plate whereby a user may manipulate with his fingers to cause said pull plate to displace forwardly or rearwardly within said base; and a bottom plate, including a planar bottom side, a pair of stop pieces being provided at each axial end adapted to close the ends of said grooves of said base, and an upper side provided with securing pins corresponding to said elongate slots of said pull plate in number and being coupled to said pull plate, said base, and said binding ring assemblies.

2. The paper binding device as claimed in claim 1, wherein one of said binding ring assemblies may be designed to be fixed so that only one of said binding ring assemblies is operable to open or close when said pull plate is pulled.

3. The paper binding device as claimed in claim 1, wherein said binding ring assemblies are more than two.

4. The paper binding device as claimed in claim 1, wherein said guide slots are capable of controlling the open angle of the binding ring elements by means of the change in angle and distance thereof with respect to said binding ring assemblies.

5. The paper binding device as claimed in claim 1, wherein said binding ring elements may be binding elements capable of opening and closing and having any shape.

6. The paper binding device as claimed in claim 1, wherein said bottom plate may be eliminated, and said base, said pull plate, and said binding ring assemblies are assembled together before being directed mounted on a file or folder or the like.

* * * * *